US009084052B2

(12) United States Patent
Biessy et al.

(10) Patent No.: US 9,084,052 B2
(45) Date of Patent: Jul. 14, 2015

(54) MOVING COIL MINIATURE LOUDSPEAKER MODULE

(71) Applicants: Henrik Lerche Biessy, Valby (DK); Lars Lindemose, Smorum (DK); Jan Naaby, Jorlunde (DK)

(72) Inventors: Henrik Lerche Biessy, Valby (DK); Lars Lindemose, Smorum (DK); Jan Naaby, Jorlunde (DK)

(73) Assignee: ANALOG DEVICES GLOBAL, Hamilton (BM)

( * ) Notice: Subject to any disclaimer, the term of this patent is extended or adjusted under 35 U.S.C. 154(b) by 0 days.

(21) Appl. No.: 13/927,319

(22) Filed: Jun. 26, 2013

(65) Prior Publication Data

US 2015/0003663 A1 Jan. 1, 2015

(51) Int. Cl.

| | |
|---|---|
| ***H04R 1/06*** | (2006.01) |
| ***H04R 9/02*** | (2006.01) |
| *H04R 9/04* | (2006.01) |

(52) U.S. Cl.

CPC ..... *H04R 1/06* (2013.01); *H04R 9/025* (2013.01); *H04R 9/045* (2013.01); *H04R 2209/024* (2013.01)

(58) Field of Classification Search

CPC ..... H04R 1/02; H04R 1/025; H04R 1/026; H04R 1/028; H04R 1/04; H04R 1/06; H04R 9/02; H04R 9/025; H04R 9/04; H04R 9/045; H04R 2209/024; H04R 2240/03; H05K 1/0393

USPC ..... 381/323, 355–368, 370, 374, 384, 386, 381/393–422, 189, 324

See application file for complete search history.

(56) References Cited

U.S. PATENT DOCUMENTS

| | | | | |
|---|---|---|---|---|
| 4,539,442 | A * | 9/1985 | Puls et al. | 381/409 |
| 5,482,473 | A * | 1/1996 | Lord et al. | 439/67 |
| 6,618,487 | B1 * | 9/2003 | Azima et al. | 381/152 |
| 6,665,416 | B1 * | 12/2003 | Choi | 381/412 |
| 7,062,063 | B2 * | 6/2006 | Hansen et al. | 381/421 |
| 7,447,327 | B2 * | 11/2008 | Kitamura et al. | 381/410 |
| 7,548,632 | B2 * | 6/2009 | Fukuyama et al. | 381/429 |
| 8,731,223 | B2 * | 5/2014 | Seo et al. | 381/338 |
| 8,774,448 | B2 * | 7/2014 | Li et al. | 381/400 |
| 2003/0048911 | A1 * | 3/2003 | Furst et al. | 381/96 |
| 2003/0174856 | A1 * | 9/2003 | Johannsen et al. | 381/401 |
| 2006/0050906 | A1 * | 3/2006 | Van Halteren et al. | 381/182 |
| 2010/0104127 | A1 * | 4/2010 | Cobb | 381/404 |

(Continued)

FOREIGN PATENT DOCUMENTS

| | | | |
|---|---|---|---|
| EP | 1 686 834 | A1 | 8/2006 |
| EP | 2 198 630 | B1 | 6/2012 |
| WO | 2004/012068 | A1 | 2/2004 |

*Primary Examiner* — Curtis Kuntz
*Assistant Examiner* — Joshua A Kaufman
(74) *Attorney, Agent, or Firm* — Kenyon & Kenyon LLP

(57) ABSTRACT

A miniature loudspeaker may include a driver module with a flexible carrier having a proximal portion arranged within the perimeter of the frame and a distal portion arranged outside the perimeter of the frame, the flexible carrier carrying an output amplifier. The flexible carrier may be provided with electrically conductive traces connecting an amplifier input with input contact pads placed on the distal portion. The flexible carrier may be provided with electrically conductive traces connecting an amplifier output with output contact pads placed at the proximal portion. The output amplifier may be arranged on the proximal portion of the flexible carrier within the perimeter of the frame. The proximal portion of the flexible carrier may be rigidly attached to the static part. The output contact pads may be connected with the voice coil through flexible lead wires.

20 Claims, 3 Drawing Sheets

(56) References Cited

U.S. PATENT DOCUMENTS

| | | | | |
|---|---|---|---|---|
| 2011/0249859 | A1 | 10/2011 | Lee | |
| 2011/0274309 | A1 | 11/2011 | Doh et al. | |
| 2011/0317868 | A1* | 12/2011 | Tsujii | 381/400 |
| 2012/0033837 | A1* | 2/2012 | Mitsui et al. | 381/191 |
| 2014/0056465 | A1* | 2/2014 | Li et al. | 381/400 |
| 2014/0133690 | A1* | 5/2014 | Yang | 381/400 |

* cited by examiner

MOVING COIL MINIATURE LOUDSPEAKER MODULE

The present invention relates in one aspect to an improved miniature loudspeaker of the moving coil type, in particular to a moving coil miniature loudspeaker for use in mobile devices. In a further aspect, the invention relates to a mobile device comprising such a moving coil miniature loudspeaker.

BACKGROUND OF THE INVENTION

Miniature loudspeakers are built into numerous mobile devices for reproducing sound, most of which are sold in a highly competitive consumer-electronics market with very tight constraints both in terms of cost, size, and weight, yet demanding a high level of sound quality. Examples for such mobile devices are mobile phones, smart phones, tablets, cameras, and small portable music players.

Components for use in such compact and light-weight mobile devices are therefore subject to severe geometric constraints. Among the geometric constraints are a small footprint and in particular a small height of the loudspeaker, in order to be suited for mounting in a device with the severe form factor limitations inherent to mobile devices. Typically, the lateral dimensions of a miniature loudspeaker defining its foot-print are between 6 mm and 30 mm, and the axial dimension defining the height of the miniature loudspeaker may be between 1 mm and 5 mm. A typical miniature loudspeaker for mobile applications is therefore a relatively flat, essentially planar device, which typically has a round, rounded, or rectangular contour as seen in the lateral plane.

Mobile devices, such as smartphones and mobile phones, also comprise a multitude of components operating at RF frequencies and emitting electromagnetic radiation in a broad range of frequencies. Due to the compact design of the mobile devices, this results in a high intensity broad band electromagnetic radiation. When designing components to be used in mobile devices, the susceptibility to a high intensity RF radiation is therefore a further constraint. Owing to the highly compact miniaturized design, planar miniature loudspeakers are typically susceptible to parasitic electromagnetic radiation emitted in the vicinity as electromagnetic interference (EMI), which may be picked up by the voice coil, or other electrical wiring of the miniature loudspeaker, as noise signal affecting the quality of sound reproduction. Further due to the miniaturized design, the miniature loudspeaker is susceptible to harmonic distortion, e.g. due to external load on the mechanical system of the loudspeaker, which again may affect the quality of sound reproduction.

Furthermore, the miniature loudspeaker has to be suited for mounting on a main printed circuit board (PCB) of the mobile device in a high throughput low-cost process. While many electronic devices are suited for surface mounting, miniature loudspeakers are commonly not compatible with such a mounting process, since the heat typically applied during the manufacturing process would affect the permanent magnetic structure included in the speaker. In addition, when mounting the miniature loudspeaker on a main PCB, additional constraints of appropriate vibration-control in the connection between the loudspeaker and the main PCB apply, due to the very nature of the loudspeaker as a sound-pressure/vibration generating device. For example, such miniature loudspeakers are often mechanically clamped to the main PCB using spring-loaded contacts for establishing electrical connections between the loudspeaker and the main PCB. Such spring-loaded contacts may constitute a noticeable item in the total cost of such a miniature loudspeaker, and a lower cost solution is therefore desirable.

It is therefore desirable to provide a miniature loudspeaker suited for consumer market mobile devices overcoming the above mentioned problems. In particular, there is a need for a low-cost miniature loudspeaker module with an improved packaging design suited for reliable low-cost mounting and overcoming the challenges of electromagnetic noise susceptibility and/or harmonic distortion of known packaging designs within the severe constraints on cost and size mentioned above.

SUMMARY OF THE INVENTION

A first aspect of the invention relates to a moving coil miniature loudspeaker comprising a static part with a frame defining a principal plane of the miniature loudspeaker and having peripheral walls defining a lateral perimeter, and with a magnetic circuit arranged within the perimeter of the frame and rigidly attached thereto, the magnetic circuit comprising a permanent magnet, an air gap, and pole pieces of magnetically conducting material, the magnetic circuit being configured to generate a magnetic field in the air gap, and a movable diaphragm assembly configured for excursion in an axial direction perpendicular to the principal plane, the diaphragm assembly comprising a diaphragm arranged parallel to the principal plane of the miniature loudspeaker, wherein the diaphragm along its periphery is resiliently attached to the peripheral walls of the frame, and a voice coil attached to a rear side of the diaphragm, wherein the voice coil extends into the air gap, the miniature loudspeaker further comprising a driver module with a flexible carrier having a proximal portion arranged within the perimeter of the frame and a distal portion arranged outside the perimeter of the frame, the flexible carrier carrying an out-put amplifier, wherein the flexible carrier is provided with electrically conductive traces connecting an amplifier input with input contact pads placed on the distal portion, and wherein the flexible carrier is further provided with electrically conductive traces connecting an amplifier output with output contact pads placed at the proximal portion, wherein the output amplifier is arranged on the proximal portion of the flexible carrier within the perimeter of the frame, wherein the proximal portion of the flexible carrier is rigidly attached to the static part, and wherein the output contact pads are connected with the voice coil through flexible lead wires.

As mentioned above, a typical miniature loudspeaker for mobile applications is usually a relatively flat, essentially planar device, which typically has a round, rounded, or rectangular contour as seen in the lateral plane, wherein the term 'lateral' refers to directions parallel to a principal plane of the miniature loudspeaker module and perpendicular to the direction of diaphragm excursion. The term 'axial' refers to directions parallel to the direction of diaphragm excursion. A device may be considered as relatively flat, if an aspect ratio of a minimum dimension in lateral directions as compared to a dimension in the axial direction is at least 2:1, preferably at least 3:1, or even 4:1.

To achieve the relatively flat, essentially planar geometry, the miniature loudspeaker has a static part with a frame defining a principal plane and a lateral perimeter of the miniature loudspeaker. A moveable diaphragm assembly comprises a diaphragm and a voice coil. The diaphragm is essentially planar, arranged parallel to the principal plane, and substantially covers a front side of the miniature loudspeaker. Along its periphery, the diaphragm is resiliently attached to the frame. A voice coil is typically directly attached to a rear side of the diaphragm facing away from the front side of the miniature loudspeaker as seen in an axial direction. The windings of the voice coil are arranged within the frame parallel to the principal plane and follow along the periphery of the diaphragm. The voice coil is received in a circumferential groove forming the air gap of a magnetic circuit in the static part. The diaphragm assembly is thus configured for excursion in an axial direction perpendicular to the principal plane.

The voice coil is driven by an output amplifier. The output amplifier is placed on a proximal portion of a flexible carrier, such as an FPCB, wherein the proximal portion of the flexible carrier is rigidly attached to the static part within the perimeter of the frame.

By integrating the output amplifier electronics within the perimeter of the frame of the miniature loudspeaker, the length of leads between the output amplifier and the voice coil driven by it is brought to a minimum. As a consequence, noise, stemming from electromagnetic radiation at RF-frequencies that are demodulated into the audio-band and picked up by the signal path between output amplifier and voice coil, is greatly reduced and loudspeaker performance is improved. Furthermore, this design overcomes the need for additional signal filtering components in the signal path between the output amplifier and the voice coil. This considerably simplifies the integration of the miniature module in a host circuit, reducing the cost of the host device. Furthermore, such additional signal filtering components may add to the impedance of the loudspeaker with a contribution that may be comparable to the impedance of the voice coil itself. An increased impedance load in the signal path deteriorates the sensitivity of the loudspeaker. By avoiding additional signal filtering components the sensitivity of the loudspeaker module is improved, and consequently the performance of the host device comprising the loudspeaker module is enhanced.

Furthermore, the miniature loudspeaker is thereby packaged as a self-contained module with integrated amplifier electronics that is well protected from external influences during handling and mounting, thus further simplifying the design and the production of mobile devices comprising the miniature loudspeaker module.

In particular, the proximal portion of the flexible carrier is rigidly attached to the static part of the miniature loudspeaker rather than being attached to the movable diaphragm assembly. Electrical connection between the output amplifier and the voice coil is achieved via highly flexible lead wires. By this particular mechanical design any additional mass and thus mechanical load on the movable diaphragm assembly is avoided, thereby improving the sensitivity and total harmonic distortion performance (THD) of the miniature loudspeaker. A distal portion of the flexible carrier protrudes from the perimeter of the frame. Electrical connection between the output amplifier and a host circuit on which it is mounted is established via the flexible carrier, which is provided with electrically conductive traces connecting an amplifier input with input contact pads placed on the distal portion of the flexible carrier. The input contact pads may be fixedly attached to the host circuit to ensure a reliable electrical connection, whereas the flexible carrier may bend to decouple/relief mechanical/vibrational load on said electrical connection. The flexible carrier thus allows for easy mounting of the miniature loudspeaker on a host circuit of e.g. a mobile device in a manner compatible with high volume production and compliant with strain relief and/or vibration control requirements for mounting of the miniature speaker.

Further according to one embodiment of the miniature loudspeaker, the proximal portion of the flexible carrier is clamped between the frame and the magnetic circuit. Thereby, during assembly, the flexible carrier may be attached to the frame prior to mounting the magnetic circuit. Once mounted, the proximal portion of the flexible carrier is held in place and the output amplifier, and as case may be, associated electronic components, are protected between the frame and the magnetic circuit.

Advantageously according to one embodiment of the miniature loudspeaker, a part of the proximal portion carrying the output contact pads is arranged on a front side portion of the frame facing outwardly in an axial direction. Thereby assembly of the miniature loudspeaker module from the top is facilitated, including a step for mounting the flexible wires from the voice coil on the front side of the frame. The flexible carrier can then be carefully bended along the inside of the frame to be clamped between the frame and components of the magnetic circuit. The distal portion of the flexible carrier is passed through a laterally oriented opening of the frame, which preferably is located close to the rear side of the frame, and projects in a lateral direction from the frame.

Further according to one embodiment of the miniature loudspeaker, the output amplifier is received in a recess/cut-out in the frame on an inwardly facing part of one of the peripheral walls. Thereby an improved encapsulation/protection of the output amplifier components is achieved. This embodiment is particularly advantageous when referring to the above-mentioned embodiment with output contact pads arranged on a front side portion of the frame, and wherein the flexible carrier passes around the inside of a peripheral wall of the frame, and through a sideways oriented opening to laterally project from the frame; In such an embodiment, the output amplifier and possibly associated components are placed on a side opposite to the output contact pads to fit in the recess/cut-out provided in the frame.

Further according to one embodiment of the miniature loudspeaker, the proximal portion of the flexible carrier is clamped between the permanent magnet and one of the pole pieces.

Further according to one embodiment of the miniature loudspeaker, the output amplifier is received in a recess/cut-out in said one pole piece. Thereby an integration of the output amplifier within the perimeter of the miniature loudspeaker's frame is achieved without substantial change to the outer dimensions of the module, yet without affecting the flux guiding performance of the magnetic circuit.

Further according to one embodiment of the miniature loudspeaker, the magnetic circuit comprises a planar slab-shaped permanent magnet sandwiched between two planar slab-shaped pole pieces, wherein said slab-shaped permanent magnet and said slab-shaped pole pieces are arranged parallel to the principal plane, wherein an upper one of the two pole pieces is located between the permanent magnet and the diaphragm, and wherein a lower one of the two pole pieces is located on an opposite side of the permanent magnet, i.e. on the side facing away from the diaphragm. This slab-shaped geometry is particularly advantageous for obtaining the relatively flat, essentially planar geometry of typical miniature loudspeakers.

Further according to one embodiment of the miniature loudspeaker, the permanent magnet and an upper pole piece are shaped and dimensioned to fit within the clearance of the voice coil in lateral directions, and a lower pole piece is shaped and dimensioned in lateral directions to extend beyond the permanent magnet and the voice coil, and in an axial direction to project upwardly towards the diaphragm, so as to form a circumferential air gap into which the voice coil fits with freedom to move in an axial direction. Thereby, a circumferential air-gap following along the periphery of the diaphragm may be provided in a simple manner.

Further according to one embodiment of the miniature loudspeaker, the proximal portion of the flexible carrier is clamped between the permanent magnet and the lower pole piece.

Further according to a preferred embodiment of the miniature loudspeaker, the output amplifier is received in a recess/cut-out in the lower pole piece. By placing the power amplifier and as the case may be further electronic components associated with the output amplification within a recess or cut-out in the lower pole piece, the above-mentioned advantages of noise reduction by minimizing the length of the signal path are achieved without affecting the flux conducting performance of the magnetic circuit, and, in particular, without substantially changing the outer dimensions of the miniature loudspeaker module.

Further according to one embodiment of the miniature loudspeaker, the lateral perimeter of the frame has a circular, elliptical, rectangular or polygonal contour as seen in the principal plane.

Further according to one embodiment of the miniature loudspeaker, an upper limit for the height of the miniature loudspeaker, i.e. for a maximum dimension in the axial direction, is one of 5 mm, 4 mm, 3 mm, and 2 mm.

Further according to one embodiment of the miniature loudspeaker, a lower limit for the height of the miniature loudspeaker, i.e. for a maximum dimension in the axial direction, is 1 mm.

Further according to one embodiment of the miniature loudspeaker, an upper limit for a maximum lateral dimension of the miniature loudspeaker is one of 30 mm, 20 mm, and 10 mm.

Further according to one embodiment of the miniature loudspeaker, a lower limit for a maximum lateral dimension of the miniature loudspeaker is 6 mm.

Further according to one embodiment of the miniature loudspeaker, the output amplifier is a class-D amplifier.

To facilitate easy integration in a mobile device, the miniature loudspeaker is preferably provided as a self-contained transducer module adapted to receive an audio signal, preferably in a digitized form, and to appropriately amplify and convert that audio signal into an acoustic signal, which is emitted from an acoustic output.

Such a self-contained transducer module therefore comprises an output amplifier, preferably a class-D amplifier. A class-D amplifier may be adapted for analog input or digital input. Advantageously, the class-D amplifier is adapted for digital input. This allows omitting input capacitors, thereby reducing the number of required components. Class-D amplifiers have many advantages amongst others low power consumption and a high signal conversion precision. However, such a class-D power amplifier operates at switching frequencies in the MHz-range and may therefore emit parasitic electromagnetic radiation interfering with the other components in the mobile device in which it is to be integrated.

The high frequency switching signal of the class-D amplifier is overlaid as a high frequency component to the actual audio signal, and the leads of the signal path may act as antenna for emitting this high frequency component as parasitic electromagnetic radiation.

By reducing the length of the signal path to a minimum, the amount of emitted electromagnetic radiation stemming from the class-D output amplifier is greatly reduced. In addition to the above-mentioned advantages of reduced pick-up of demodulated RF-frequencies affecting the signal in the audio-range, the reduced signal path therefore also significantly reduces electromagnetic interference in the MHz-range with other components of the host device, such as the antenna of a mobile device.

A second aspect of the invention relates to a mobile device comprising a moving coil miniature loudspeaker according to any of the above-mentioned embodiments.

Further according to one embodiment, the mobile device is any one of a mobile phone, a smartphone, a tablet computer, a camera, or a portable music playing equipment.

BRIEF DESCRIPTION OF THE DRAWINGS

Preferred embodiments of the invention will be described in more detail in connection with the appended drawings, which show schematically in FIG. 1 a miniature loudspeaker module according to one embodiment, as seen from the top, FIG. 2 the miniature loudspeaker module of FIG. 1, as seen from below, FIG. 3 a cross-sectional side view of the miniature loudspeaker module of FIG. 1, as cut along line III-III in FIG. 1, FIG. 4 components for the assembly of the miniature loudspeaker of FIG. 1, FIG. 5 components for the assembly of a miniature loudspeaker according to a second embodiment, and in FIG. 6 a cross-sectional detail of a miniature loudspeaker module according to a third embodiment.

DETAILED DESCRIPTION OF PREFERRED EMBODIMENTS

Figure 1:
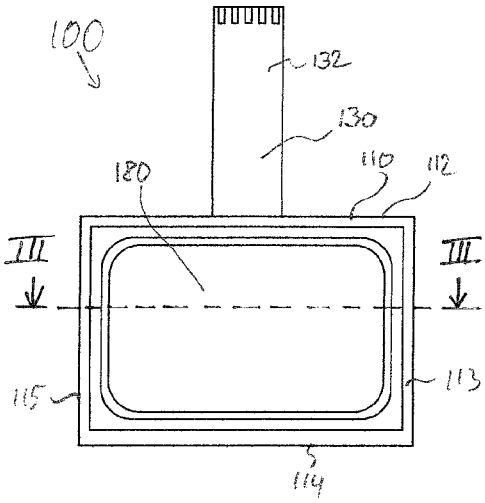
Figure 2:
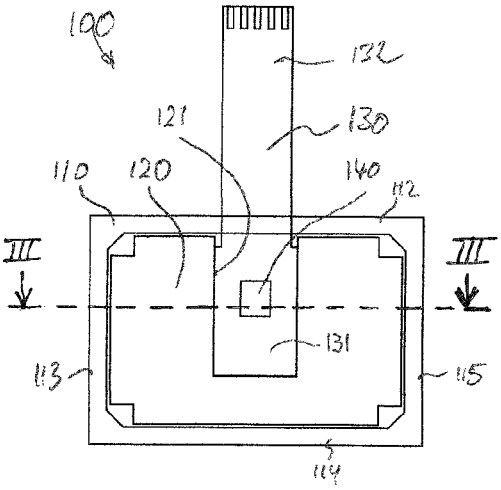
Figure 3:
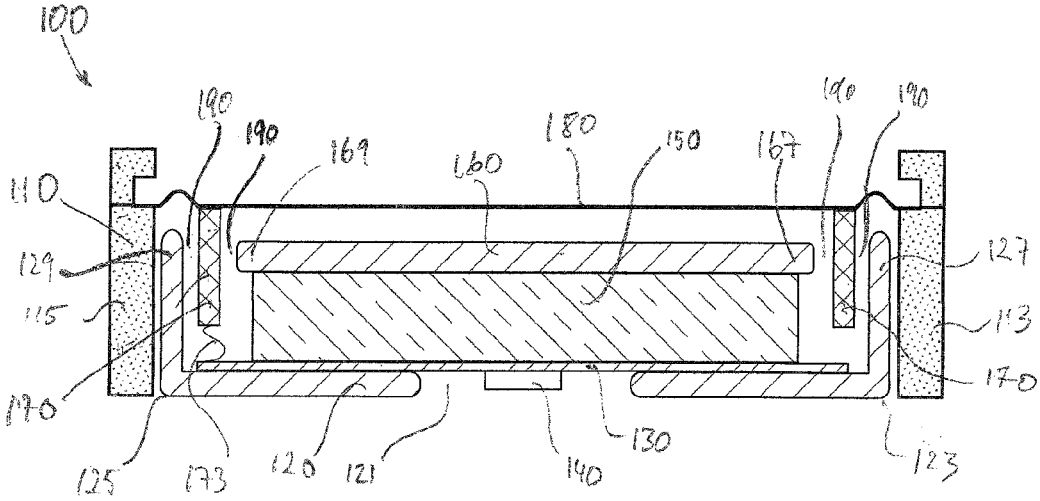
Figure 4:
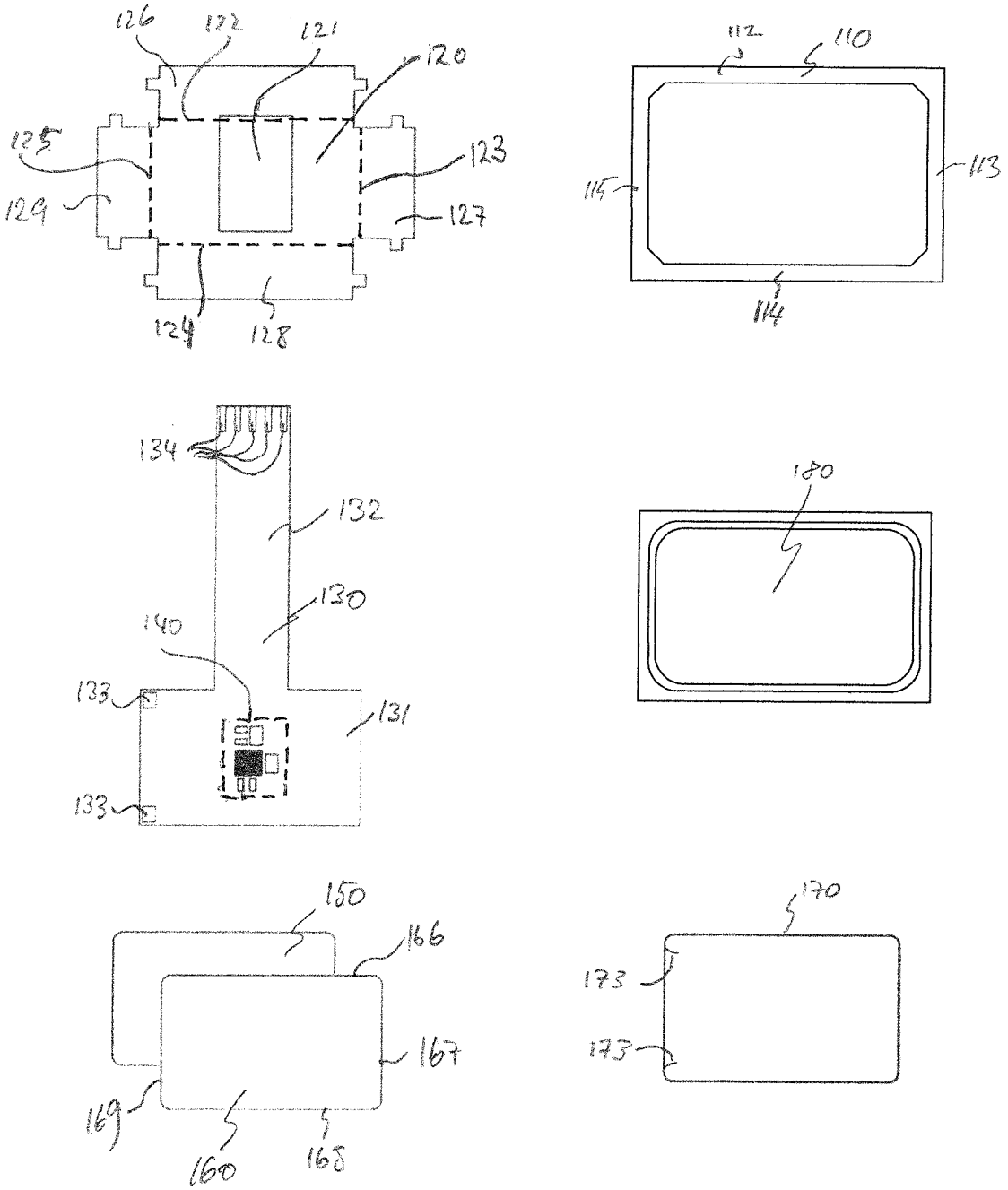

Referring to FIGS. 1-4, a moving coil miniature loudspeaker 100 comprises a static part with a frame 110 defining a principal plane of the miniature loud-speaker 100. The frame 110 has peripheral walls 112, 113, 114, 115 defining a lateral perimeter.

A magnetic circuit is arranged within the perimeter of the frame 110 and rigidly attached to the frame 110. The magnetic circuit comprises a planar slab-shaped permanent magnet 150 sandwiched between two planar slab-shaped pole pieces 120, 160 of magnetically conducting material, and an air gap 190. The slab-shaped permanent magnet 150 and the slab-shaped pole pieces 120,160 are arranged parallel to the principal plane. The upper pole piece 160 is located between the permanent magnet 150 and a diaphragm 180 at the top of the miniature loudspeaker 100; and the lower pole piece 120 is located on an opposite side of the permanent magnet 150 at the bottom of the miniature loud speaker 100. The moving coil miniature loudspeaker 100 further comprises a movable diaphragm assembly configured for excursion in an axial direction perpendicular to the principal plane. The diaphragm assembly comprises a diaphragm 180 arranged parallel to the principal plane of the miniature loud-speaker 100, wherein the diaphragm 180 along its periphery is resiliently attached to the peripheral walls 112, 113, 114, 115 of the frame 110. A voice coil 170 is attached to a rear side of the diaphragm 180 and extends into the air gap 190. The permanent magnet 150 and the upper pole piece 160 are shaped and dimensioned to fit within the clearance of the voice coil 170 in lateral directions. The lower pole piece 120 is shaped and dimensioned to extend in lateral directions beyond the permanent magnet 150 and the voice coil 170, and to project upwardly in an axial direction towards the diaphragm 180. The lower pole piece 120 may be formed by punching out the contour with a central cut-out 121 shown in FIG. 4 from a soft magnetic sheet material, and in a subsequent step, bending projections 126, 127, 128, 129 along folding lines 122, 123, 124, 125 to project perpendicularly upward. The lower pole piece 120 has thus the shape of an essentially rectangular box with an inner clearance in lateral directions corresponding to and enclosing the lateral dimensions of the voice coil 170, and a cut-out 121 extending towards the projection 126 on the long side of the rectangular box. The air gap 190 is formed as a circumferential groove between lateral edges 166, 167, 168, 169 of the upper pole piece 160 and upwardly projecting peripheral portions 126, 127, 128, 129 of the lower pole piece 120. The voice coil 170 fits into that circumferential groove with freedom to move in the axial direction to operate the diaphragm 180 in response to an audio signal applied to the voice coil 170.

The miniature loudspeaker 100 further comprises a driver module with a flexible carrier 130. The flexible carrier 130 has a proximal portion 131 arranged within the perimeter of the frame 110 and a distal portion 132 arranged outside the perimeter of the frame 110. The proximal portion 131 of the flexible carrier is rigidly attached to the static part of the miniature loudspeaker 100 and carries an output amplifier 140, preferably a class-D amplifier. The flexible carrier 130 is provided with electrically conductive traces (not shown) connecting an input of the amplifier 140 with input contact pads 134 placed on the distal portion 132. The flexible carrier 130 has further electrically conductive traces (not shown) connecting an output of the amplifier 140 with output contact pads 133 placed on the proximal portion 131. The output contact pads 133 are connected with the voice coil 170 through flexible lead wires 173. The miniature loudspeaker 100 is connectable to a host circuit of a mobile device, such as mobile phone, a smartphone, a tablet computer, a camera, or a portable music playing equipment, through input contact pads 134. The host circuit may thus transmit an audio signal via input contact pads 134 to amplifier 140, where the audio-signal is amplified. The amplified audio-signal is further transmitted to the voice coil 170 to drive the excursion of the movable diaphragm assembly thereby producing sound pressure.

As mentioned above, the output amplifier 140 is arranged on the proximal portion 131 of the flexible carrier 130 and thus within the perimeter of the frame 110. By placing the output amplifier 140 within the perimeter of the frame 110, the length of the signal path between output amplifier 140 and voice coil 170, which is most susceptible to electromagnetic interference, is minimized. The proximal portion 131 of the flexible carrier 130 is clamped between the permanent magnet 150 and the lower pole piece 120, and the output amplifier 140 is received in a recess/cut-out 121 in the lower pole piece 120. The cut-out/recess 121 is shaped, dimensioned and placed that sufficient flux conducting material remains in the lower pole piece 120 to "capture" the flux from the permanent magnet 150 and conduct the flux essentially unaffected by the cut-out/recess 121 to the air gap 190 formed between the two pole pieces 120, 160. Thereby, the output amplifier 140 is integrated in the miniature loudspeaker 100 without increasing the outer dimensions of the miniature loudspeaker 100 and without affecting the electromagnetic response of the miniature loudspeaker 100.

Figure 5:
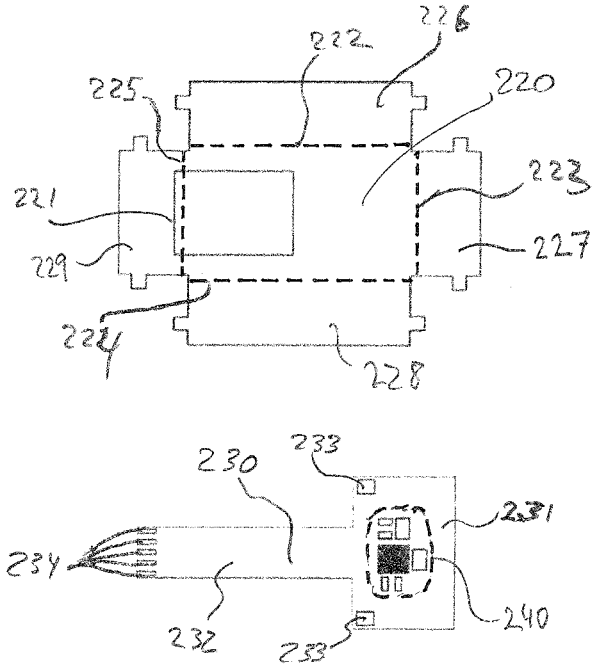

FIG. 5 illustrates an alternative embodiment, which is essentially equivalent to the first embodiment shown in FIGS. 1-4, apart from the location of the cut-out/recess in the lower pole piece and the shape of the flexible carrier. Only the components differing from the above embodiment are therefore shown in FIG. 5. As in the first embodiment, a box-shaped lower pole piece 220 may be produced, e.g. by punching out the shown contour with cut-out 221 from a sheet of soft magnetic material and forming upwardly projecting portions 226, 227, 228, 229 by bending along respective folding lines 222, 223, 224, 225. However, in this embodiment the cut-out 221 extends towards a narrow side 229. Furthermore, a corresponding is provided. The flexible carrier 230 carries an output amplifier 240 and output contacts 233 on a proximal portion 231, and input contacts 234 on a distal portion 232. The flexible carrier 230 is placed in the lower pole piece 220 such that the proximal portion 231 lies within the box, the output amplifier 240 projects downward from proximal portion 231 into the cut-out 221, and the distal portion 232 protrudes laterally sideways through the opening 221 from the narrow side 229 at the bottom of the box.

Accordingly, a cut-out/recess in the lower pole piece and a corresponding flexible carrier that is clamped between the lower pole piece and the magnet may be adjusted to any preferred lateral shape of a voice coil and diaphragm assembly, such as round, rounded, elliptic or polygonal.

Figure 6:
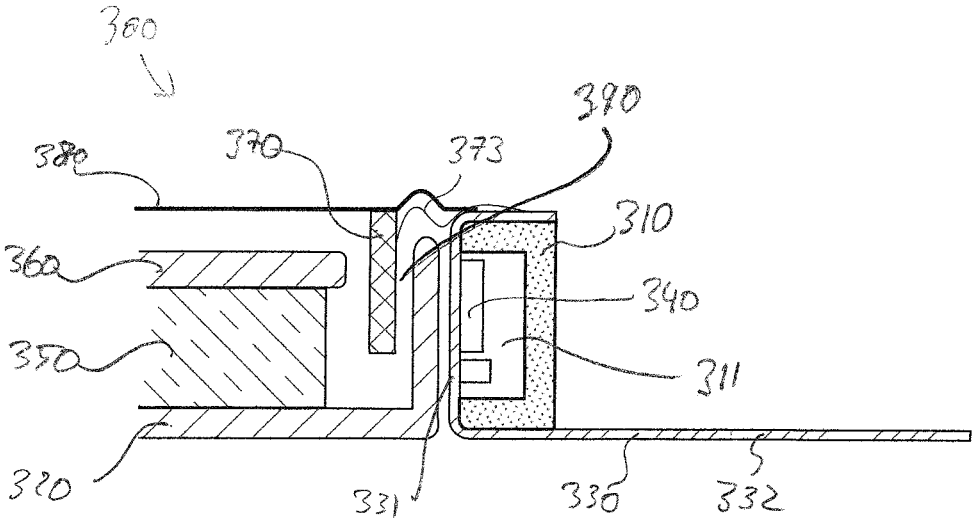

FIG. 6 shows a cross-sectional detail of a third preferred embodiment of a miniature loudspeaker 300. The miniature loudspeaker 300 has a static part comprising a frame 310, and a magnetic circuit with an upper slab-shaped pole piece 360, a permanent magnet 350, a lower slab-shaped pole piece 320, and a circumferential air gap 390 between the two pole pieces 320, 360. A moveable diaphragm assembly of the miniature loudspeaker 300 comprises a diaphragm 380 and a moving coil 370, which is attached to the rear side of the diaphragm 380. The moving coil 370 extends into the air gap 390. At its periphery, the moveable diaphragm assembly is resiliently attached to the frame 310. A driver module of the miniature loudspeaker 300 has a flexible carrier 330 with a proximal portion 331 arranged within the perimeter of the frame 310 and with a distal portion 332 protruding in a lateral direction sideways away from the frame 310. The proximal portion is at its end attached to the top side of the frame, guided around the inside between the frame 310 and the magnetic circuit, and in an outward direction through an opening at the bottom of the frame, where it goes over into the distal portion 332. The proximal portion 331 carries an output amplifier 340, wherein a recess 311 is provided on a laterally inner side of the frame 310, which is adapted to receive the output amplifier 340 within the perimeter defined by the frame 310 and in direct vicinity to the voice coil 370. Thereby, the length of the signal path from the output amplifier 340 via conductive traces (not shown), output contacts on the proximal portion 331 at the top side of the frame, and flexible leads 373 between the output contacts and the voice coil 370 is reduced to a minimum.

The invention claimed is:

1. A moving coil miniature loudspeaker comprising a static part with a frame defining a principal plane of the miniature loudspeaker and having peripheral walls defining a lateral perimeter, and with a magnetic circuit arranged within the perimeter of the frame and attached thereto, the magnetic circuit comprising a permanent magnet, an air gap, and pole pieces of magnetically conducting material, a movable diaphragm assembly configured for excursion in an axial direction perpendicular to the principal plane, the diaphragm assembly comprising a diaphragm arranged parallel to the principal plane of the miniature loudspeaker, wherein the diaphragm along its periphery is attached to the peripheral walls of the frame, and a voice coil attached to a rear side of the diaphragm, wherein the voice coil extends into the air gap, and a driver module with a flexible carrier having a proximal portion arranged within the perimeter of the frame and a distal portion arranged outside the perimeter of the frame, the flexible carrier carrying an output amplifier, wherein the flexible carrier is provided with electrically conductive traces connecting an amplifier input with input contact pads placed on the distal portion, and wherein the flexible carrier is further provided with electrically conductive traces connecting an amplifier output with output contact pads placed at the proximal portion, wherein the output amplifier is arranged on the proximal portion of the flexible carrier within the perimeter of the frame, wherein the proximal portion of the flexible carrier is attached to the static part, wherein the output contact pads are connected with the voice coil through flexible lead wires, and wherein the proximal portion of the flexible carrier is clamped between the permanent magnet and one of the pole pieces.

2. The miniature loudspeaker according to claim 1, wherein the proximal portion of the flexible carrier is clamped between the frame and the magnetic circuit.

3. The miniature loudspeaker according to claim 2, wherein the output amplifier is received in a recess/cut-out in the frame on an inwardly facing part of one of the peripheral walls.

4. The miniature loudspeaker according to claim 1, wherein the output amplifier is received in a recess/cut-out in said one pole piece.

5. The miniature loudspeaker according to claim 1, wherein the magnetic circuit comprises a planar slab-shaped permanent magnet sandwiched between two planar slab-shaped pole pieces, wherein said slab-shaped permanent magnet and said slab-shaped pole pieces are arranged parallel to the principal plane, wherein an upper one of the two pole pieces is located between the permanent magnet and the diaphragm, and wherein a lower one of the two pole pieces is located on an opposite side of the permanent magnet.

6. The miniature loudspeaker according to claim 5, wherein the permanent magnet and the upper pole piece are shaped and dimensioned to fit within the clearance of the voice coil in lateral directions, and wherein the lower pole piece is shaped and dimensioned in lateral directions to extend beyond the permanent magnet and the voice coil and in an axial direction to project upwardly towards the diaphragm, so as to form a circumferential air gap enclosing the axially displaceable voice coil.

7. The miniature loudspeaker according to claim 6, wherein the proximal portion of the flexible carrier is clamped between the permanent magnet and the lower pole piece.

8. The miniature loudspeaker according to claim 7, wherein the output amplifier is received in a recess/cut-out in the lower pole piece.

9. The miniature loudspeaker according to claim 1, wherein the lateral perimeter of the frame has a circular, elliptical, rectangular or polygonal contour as seen in the principal plane.

10. The miniature loudspeaker according to claim 1, wherein a height of the miniature loudspeaker in the axial direction, is less than one of 5 mm, 4 mm, 3 mm, and 2 mm.

11. The miniature loudspeaker according to claim 1, wherein a maximum dimension of the miniature loudspeaker in lateral directions is less than one of 30 mm, 20 mm, and 10 mm.

12. The miniature loudspeaker according to claim 1, wherein the output amplifier comprises a class-D amplifier.

13. A mobile device comprising:

a miniature loudspeaker comprising:

a static part with a frame defining a principal plane of the miniature loudspeaker and having peripheral walls defining a lateral perimeter, and with a magnetic circuit arranged within the perimeter of the frame and attached thereto, the magnetic circuit comprising a permanent magnet, an air gap, and pole pieces of magnetically conducting material, a movable diaphragm assembly configured for excursion in an axial direction perpendicular to the principal plane, the diaphragm assembly comprising a diaphragm arranged parallel to the principal plane of the miniature loudspeaker, wherein the diaphragm along its periphery is attached to the peripheral walls of the frame, and a voice coil attached to a rear side of the diaphragm, wherein the voice coil extends into the air gap, and a driver module with a flexible carrier having a proximal portion arranged within the perimeter of the frame and a distal portion arranged outside the perimeter of the frame, the flexible carrier carrying an output amplifier, wherein the flexible carrier is provided with electrically conductive traces connecting an amplifier input with input contact pads placed on the distal portion, and wherein the flexible carrier is further provided with electrically conductive traces connecting an amplifier output with output contact pads placed at the proximal portion, wherein the output amplifier is arranged on the proximal portion of the flexible carrier within the perimeter of the frame, wherein the proximal portion of the flexible carrier is attached to the static part, wherein the output contact pads are connected with the voice coil through flexible lead wires, and wherein the proximal portion of the flexible carrier is clamped between the permanent magnet and one of the pole pieces.

14. The mobile device according to claim 13, wherein the mobile device is any one of a mobile phone, a smartphone, a camera, or a portable music playing equipment.

15. The mobile device according to claim 13, wherein the proximal portion of the flexible carrier is clamped between the frame and the magnetic circuit.

16. The mobile device according to claim 15, wherein the output amplifier is received in a recess/cut-out in the frame on an inwardly facing part of one of the peripheral walls.

17. The mobile device according to claim 13, wherein the output amplifier is received in a recess/cut-out in said one pole piece.

18. The mobile device according to claim 13, wherein the magnetic circuit comprises a planar slab-shaped permanent magnet sandwiched between two planar slab-shaped pole pieces, wherein said slab-shaped permanent magnet and said slab-shaped pole pieces are arranged parallel to the principal plane, wherein an upper one of the two pole pieces is located between the permanent magnet and the diaphragm, and wherein a lower one of the two pole pieces is located on an opposite side of the permanent magnet.

19. The mobile device according to claim 18, wherein the permanent magnet and the upper pole piece are shaped and dimensioned to fit within the clearance of the voice coil in lateral directions, and wherein the lower pole piece is shaped and dimensioned in lateral directions to extend beyond the permanent magnet and the voice coil and in an axial direction to project upwardly towards the diaphragm, so as to form a circumferential air gap enclosing the axially displaceable voice coil.

20. The mobile device according to claim 19, wherein the proximal portion of the flexible carrier is clamped between the permanent magnet and the lower pole piece.

* * * * *